US009540800B2

(12) United States Patent
Laurindo

(10) Patent No.: US 9,540,800 B2
(45) Date of Patent: Jan. 10, 2017

(54) SET OF PROFILE SECTIONS FOR THE CONSTRUCTION OF WALLS, PANELS AND ANGLE SECTIONS IN THERMOPLASTIC

(71) Applicant: Ilmar Laurindo, Florianopolis (BR)

(72) Inventor: Ilmar Laurindo, Florianopolis (BR)

(73) Assignee: WALLCLICK SISTEMAS CONSTRUTIVOS LTDA., Santa Catarina (BR)

( * ) Notice: Subject to any disclaimer, the term of this patent is extended or adjusted under 35 U.S.C. 154(b) by 0 days.

(21) Appl. No.: 14/441,790

(22) PCT Filed: Sep. 10, 2013

(86) PCT No.: PCT/BR2013/000361
§ 371 (c)(1),
(2) Date: Aug. 9, 2015

(87) PCT Pub. No.: WO2014/071476
PCT Pub. Date: May 15, 2014

(65) Prior Publication Data

US 2015/0376891 A1 Dec. 31, 2015

(30) Foreign Application Priority Data

Nov. 8, 2012 (BR) ..... 20 2012 028578 4

(51) Int. Cl.

| | |
|---|---|
| ***E04B 1/28*** | (2006.01) |
| ***E04B 1/12*** | (2006.01) |
| ***E04F 13/08*** | (2006.01) |
| ***E04F 13/18*** | (2006.01) |
| ***E04B 1/38*** | (2006.01) |
| ***E04F 13/072*** | (2006.01) |

(52) U.S. Cl.
CPC . *E04B 1/28* (2013.01); *E04B 1/12* (2013.01); *E04B 1/38* (2013.01); *E04F 13/072* (2013.01); *E04F 13/0864* (2013.01); *E04F 13/18* (2013.01)

(58) Field of Classification Search
CPC ..... E04B 1/28; E04B 1/38; E04F 13/072; E04F 13/18; E04C 2/296; E04C 2/40; E04C 2003/0413; E04C 2003/043; E04C 2003/0465; E04C 2/20; E04C 2/3405
USPC ..... 52/580, 270, 284, 309.9, 309.11, 578, 52/581, 588.1, 592.1, 745.05
See application file for complete search history.

(56) References Cited

U.S. PATENT DOCUMENTS

| | | | | |
|---|---|---|---|---|
| 3,386,218 A * | 6/1968 | Scott | E04B 1/6803 | 52/309.11 |
| 3,760,548 A * | 9/1973 | Sauer | E04B 1/6179 | 52/309.11 |
| 4,015,545 A * | 4/1977 | Kurokawa | A47F 3/001 | 108/107 |
| 4,186,539 A * | 2/1980 | Harmon | E04B 1/6129 | 52/580 |

(Continued)

*Primary Examiner* — Robert Canfield
*Assistant Examiner* — Matthew Gitlin

(57) ABSTRACT

Set of profile sections for the construction of walls, panels and angle sections in thermoplastic, which is a set of components in the form of a profile section, extruded from PVC-type semi-rigid or similar material, and each component has a male and a female recess along the generatrix of the profile section, and these are joined to form assemblies that constitute articles for industrial use, such as walls, cladding for existing walls, roofing, panels, doors, windows, enclosures, balconies, partitions, bus stops, telephone kiosks, bath panels, screens, etc.

1 Claim, 8 Drawing Sheets

(56) References Cited

U.S. PATENT DOCUMENTS

| | | | | | |
|---|---|---|---|---|---|
| 5,277,011 | A * | 1/1994 | Serrano Martin | E04B 7/22 | 52/309.9 |
| 5,718,276 | A * | 2/1998 | Rekret | E05D 15/242 | 160/201 |
| 5,836,128 | A * | 11/1998 | Groh | E04B 5/12 | 52/314 |
| 5,934,040 | A * | 8/1999 | Chen | B29C 65/00 | 52/309.11 |
| 6,658,808 | B1 * | 12/2003 | Doherty | E04B 1/12 | 52/579 |
| 2004/0060245 | A1 * | 4/2004 | Loblick | E04B 1/12 | 52/79.5 |
| 2007/0062146 | A1 * | 3/2007 | Van Dijk | E04B 1/12 | 52/580 |
| 2010/0212241 | A1 * | 8/2010 | Holroyd | E04B 1/12 | 52/309.4 |

* cited by examiner

PEÇA 01

PEÇA 02

PEÇA 03

PEÇA 04

PEÇA 05

PEÇA 06

PEÇA 07

PEÇA 08

PEÇA 09

PEÇA 10

PEÇA 11

PEÇA 12

PEÇA 13

PEÇA 14

PEÇA 35
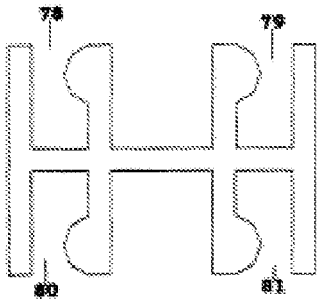
FIG 29
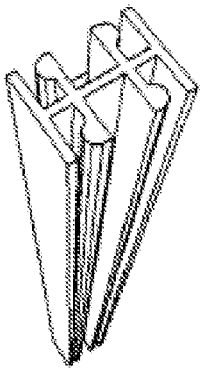
FIG 30
FIG 31
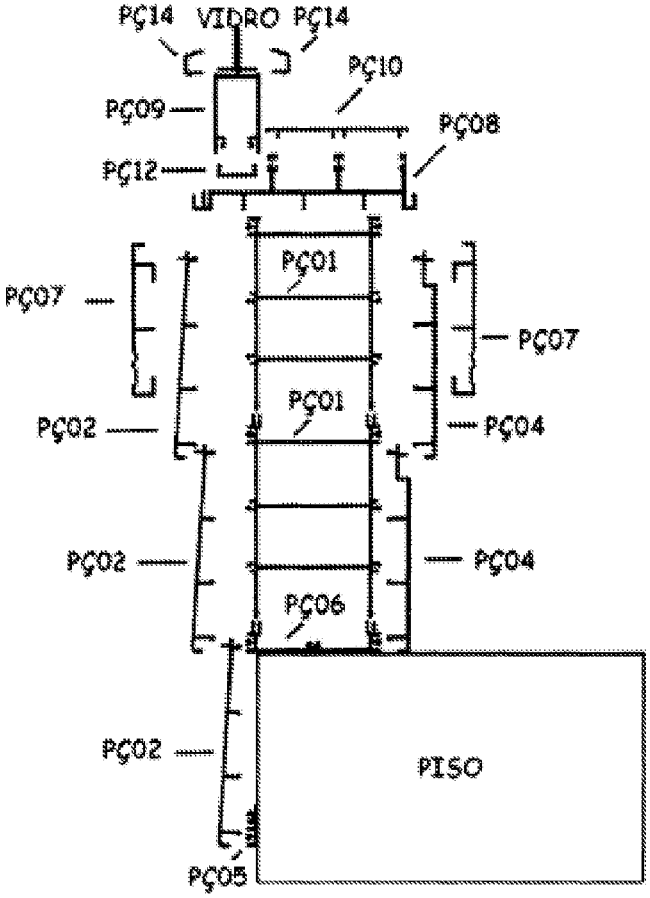

SET OF PROFILE SECTIONS FOR THE CONSTRUCTION OF WALLS, PANELS AND ANGLE SECTIONS IN THERMOPLASTIC

The present patent for a utility model refers to a set of rigid sections with low resilience extruded from plastic, which are fitted to each other to develop walls, cladding for existing walls, roofing, panels, doors, windows, enclosures, balconies, partitions, bus stops, telephone kiosks, bath panels, screens, etc.

The profiled extrusion sections have variable length and are fitted to each other in a male-female system.

The kinds of materials used for machining such set of extrusion sections are: PVC, PP, PS, PLASTIC, NYLON, ALUMINUM, ETC.

The unique characteristics between a wall for the erection of a building as existing in the market today and this set of extrusion parts is the substitution of the use of materials such as: masonry (bricks, sand, cement, lime, etc.), cardboard plaster, cement plates, wood, etc., as conventionally used in civil architecture, pre-molded materials, steel frame and wood frame. Said set will provide for the construction of a wall eliminating these materials, using just PVC or another thermoplastic material, clicking one part above the other, horizontally (piling them up), using steel beams and columns as a structural part of a cover or even the floor, thus enabling the construction with quicker handwork and at lower cost than the processes as previously mentioned, not comprising resistance and safety. They offer the advantages of better thermal and acoustic isolation and resistance against storms, also offering easy maintenance for the substitution of sections and project modification (future reforms), as originated from this set of extrusion sections. To better understand the set of sections, drawings of individual sections and a drawing of a few examples of the industrial application of a group of sections conveniently fit to each other are presented.

BRIEF DESCRIPTION OF THE DRAWINGS

FIG. 29 shows a cross-sectional view of the section (15) having a straight double "H"-shaped section with four female fittings.

FIG. 30 shows a perspective view of the section (15) having a straight double "H"-shaped section with four female fittings.

FIG. 31 shows a perspective view of a building structure comprising sections 1-15 illustrated in FIG.1-FIG.30.

DETAILED DESCRIPTION OF THE PREFERRED EMBODIMENTS

Figure 1:
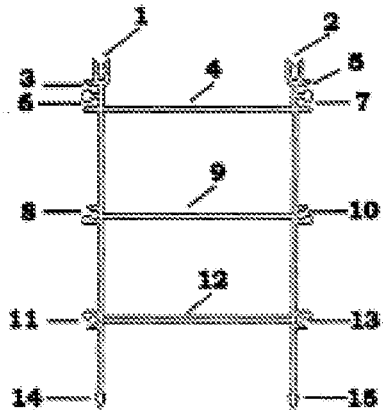
FIG. 1 shows an isometric perspective view of the section (1) having a straight rectangular-shaped section with 10 (ten) female fittings.
Figure 2:
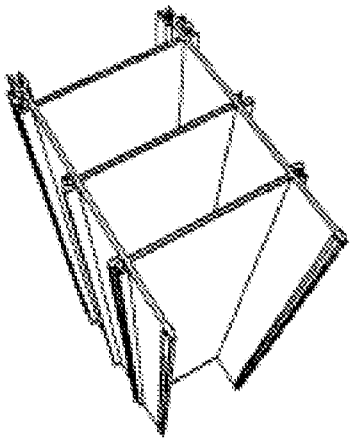
FIG. 2 shows a perspective view of the section (1) having a straight rectangular-shaped section with 10 (ten) female fittings.

FIGS. 1 and 2 show a cut design in isometric perspective of the section (1) having a straight rectangular-shaped section (as a shelf rack) with 10 (ten) female fittings, of which two (1 and 2) serve to fit the back end of another profile with the same shape. The fittings (3, 5, 6, 7, 8, 10, 11 and 13) serve to receive the fitting of the sections 2, 3 and 4. Male fittings (14 and 15) serve to fit the upper part of another profile with the same shape. The crossbars (4, 9 and 12) serve to generate contraction, providing mechanical resistance to the profile, also creating hollow chambers inside it to install Styrofoam blocks so to enhance thermal and acoustic isolation.

Figure 3:
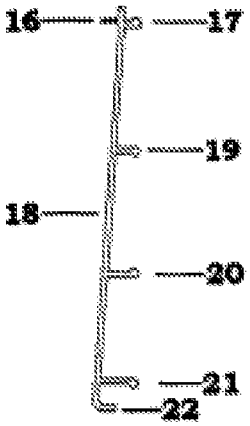
FIG. 3 shows a cut design in isometric perspective of the section (2) having a straight rod-shaped section, with 4 male fittings.
Figure 4:
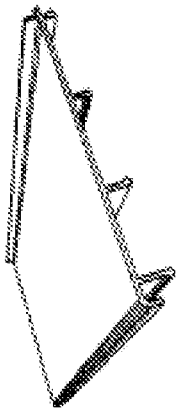
FIG. 4 shows a perspective view of the section (2) having a straight rod-shaped section, with 4 male fittings.

FIGS. 3 and 4 show a cut design in isometric perspective of the section (2) having a straight rod-shaped section, with 4 male fittings (17, 19, 20, 21) serving to connect the side edges of the section 1. The fittings (16 and 22) serve to fit another profile with the same shape to avoid water infiltration. The wall (18) defines the shape of the profile, which, in this case, forms a wainscot wall.

Figure 5:
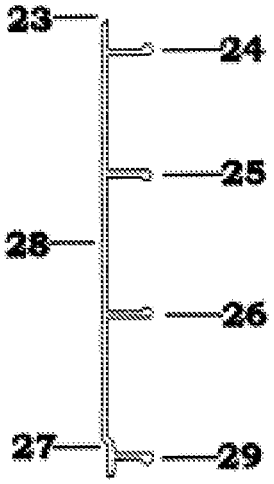
FIG. 5 shows a cross-sectional view of the section (3) having a straight rod-shaped section and 4 hanger-shaped fittings.
Figure 6:
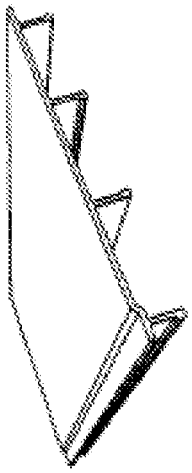
FIG. 6 shows a perspective view of the section (3) having a straight rod-shaped section and 4 hanger-shaped fittings.

FIGS. 5 and 6 show a cut design in isometric perspective of the section (3) having a straight rod-shaped section and 4 hanger-shaped fittings, which (24, 25, 26 and 29) serve to connect the side edges of the part 1. The edges (23 and 27) serve to fit another profile with the same shape, to avoid water infiltration. The wall (28) defines the shape of the profile, which, in this case, forms a straight wall.

Figure 7:
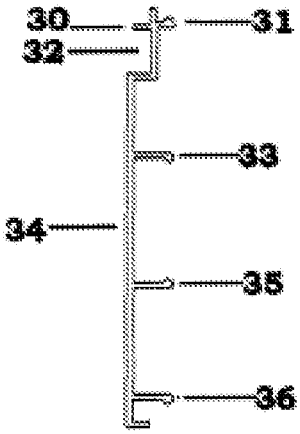
FIG. 7 shows a cross-sectional view of the section (4) having a straight rod-shaped section and four male fittings.
Figure 8:
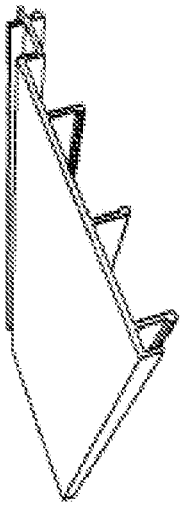
FIG. 8 shows a perspective view of the section (4) having a straight rod-shaped section and four male fittings.

FIGS. 7 and 8 show a cut design in isometric perspective of the section (4) having a straight rod-shaped section and four male fittings (31, 33, 35 and 36), serving to connect the side edges of the section 1. The edge (30) serves to fit another profile with the same shape to avoid water infiltration. The walls (32 and 34) define the shape of the profile, which, in this case, forms a straight wall with negatives.

Figure 9:
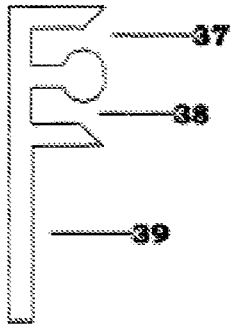
FIG. 9 shows a cut design in isometric perspective of the section (5) having a straight "F"-shaped section with two female fittings.
Figure 10:
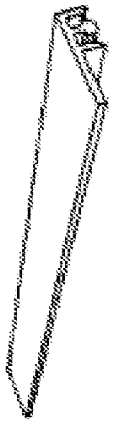
FIG. 10 shows a perspective view of the section (5) having a straight "F"-shaped section with two female fittings.

FIGS. 9 and 10 show a cut design in isometric perspective of the section (5) having a straight "F"-shaped section with two female fittings (37 and 38) serving to connect the parts 2, 3 and 4, thus creating cladding on the walls, already existing panels and roofs, substituting conventional tiles. The wall (39) serves to fix screws.

Figure 11:
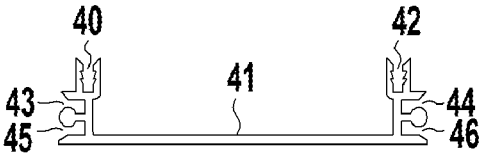
FIG. 11 shows a cross-sectional view of the section (6) having a straight "U"-shaped section with six female fittings.
Figure 12:
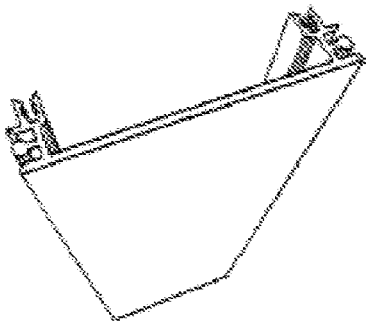
FIG. 12 shows a perspective view of the section (6) having a straight "U"-shaped section with six female fittings.

FIGS. 11 and 12 show a cut design in isometric perspective of the section (6) having a straight "U"-shaped section with six female fittings, two of which (40 and 42) serve to connect male fittings of the section 1. The other fittings (43, 44, 45 and 46) serve to connect male fittings of the sections 2, 3 and 4.

Figure 13:
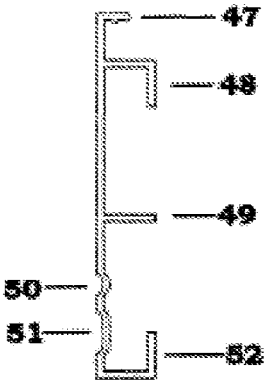
FIG. 13 shows a cross-sectional view of the part (7) having a straight "E"-shaped section having four edges.
Figure 14:
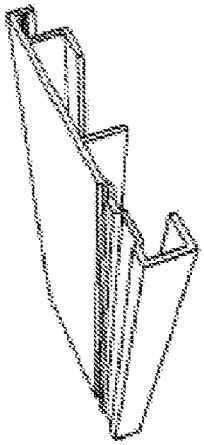
FIG. 14 shows a perspective view of the part (7) having a straight "E"-shaped section having four edges.

FIGS. 13 and 14 show a cut design in isometric perspective of the part (7) having a straight "E"-shaped section having four edges. One edge (47) serves to fit an opening. The other edges (48 and 52) are for double-face fitting. Grooves (50 and 51) serve as a finishing detail, since they are a skirting or opening view.

Figure 15:
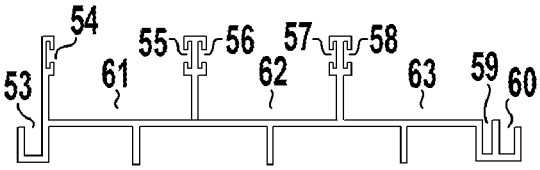
FIG. 15 shows a cross-sectional view of the section (8) with a straight trail-shaped section, having eight female fittings.
Figure 16:
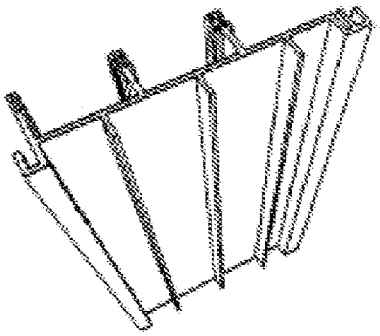
FIG. 16 shows a perspective view of the section (8) with a straight trail-shaped section, having eight female fittings.

FIGS. 15 and 16 show a cut design in isometric perspective of the section (8) with a straight trail-shaped section, having eight female fittings. The fittings (54, 55, 56, 57 and 58) serve to fit sealing screws. The fitting (59) serves to fit a fourth rail. The fittings (53 and 60) serve to fit the finishing view.

Figure 17:
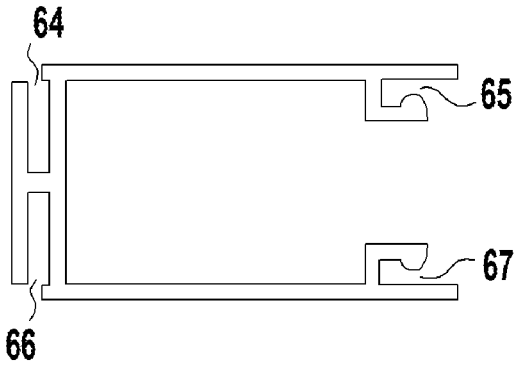
FIG. 17 shows a cross-sectional view of the section (9) having a straight "U"-shaped section having four female fittings.
Figure 18:
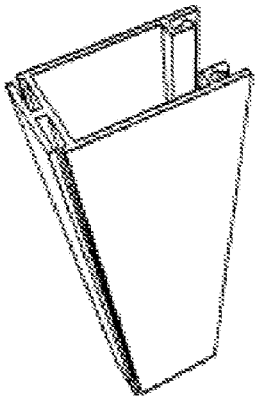
FIG. 18 shows a perspective view of the section (9) having a straight "U"-shaped section having four female fittings.

FIGS. 17 and 18 show a cut design in isometric perspective of the section (9) having a straight "U"-shaped section having four female fittings. The fittings (64 and 66) serve to fit the parts fixing a glass, lining or blind. Fittings (65 and 67) serve to receive the closing part and profile finishing.

Figure 19:
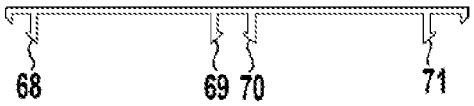
FIG. 19 shows a cross-sectional view of the section (10) having a straight hanger-shaped section with four male fittings.
Figure 20:
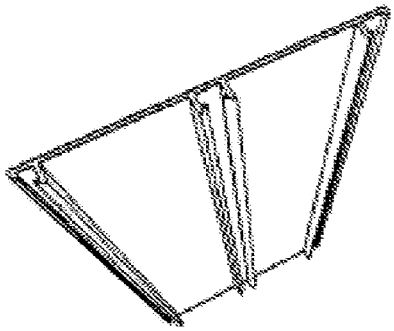
FIG. 20 shows a perspective view of the section (10) having a straight hanger-shaped section with four male fittings.

FIGS. 19 and 20 show a cut design in isometric perspective of the section (10) having a straight hanger-shaped section with four male fittings. The fittings (68, 69, 70 and 71) serve to connect the section 8.

Figure 21:
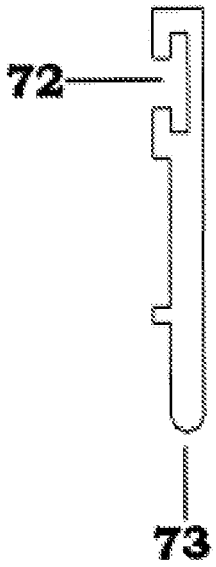
FIG. 21 shows a cross-sectional view of the section (11) having a straight key-shaped section with a female fitting.
Figure 22:
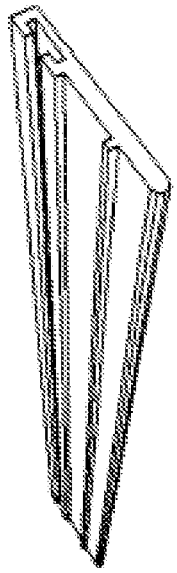
FIG. 22 shows a perspective view of the section (11) having a straight key-shaped section with a female fitting.

FIGS. 21 and 22 show a cut design in isometric perspective of the section (11) having a straight key-shaped section with a female fitting. The fitting (72) serves to fit a sealing brush. The male fitting (73) serves to connect the section 8.

Figure 23:
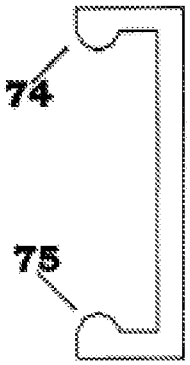
FIG. 23 shows a cross-sectional view of the section (12) having a straight "C"-shaped section with two male fittings.
Figure 24:
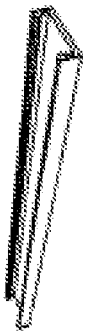
FIG. 24 shows a perspective view of the section (12) having a straight "C"-shaped section with two male fittings.

FIGS. 23 and 24 show a cut design in isometric perspective of the section (12) having a straight "C"-shaped section with two male fittings. The fittings (74 and 75) serve to connect the section 9.

Figure 25:
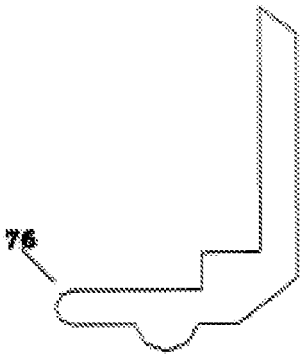
FIG. 25 shows a cross-sectional view of the section (13) having a straight "L"-shaped section with a male fitting.
Figure 26:
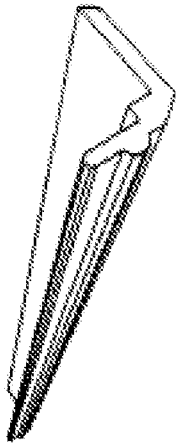
FIG. 26 shows a perspective view of the section (13) having a straight "L"-shaped section with a male fitting.

FIGS. 25 and 26 show a cut design in isometric perspective of the section (13) having a straight "L"-shaped section with a male fitting. The fitting (76) serves to connect the section 9.

Figure 27:
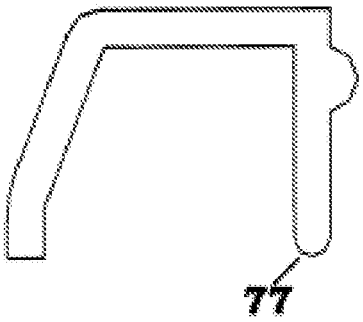
FIG. 27 shows a cross-sectional view of the section (14) having a straight "n"-shaped section with a male fitting.
Figure 28:
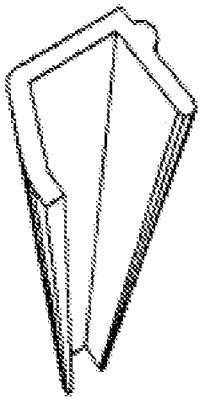
FIG. 28 shows a perspective view of the section (14) having a straight "n"-shaped section with a male fitting.

FIGS. 27 and 28 show a cut design in isometric perspective of the section (14) having a straight "n"-shaped section with a male fitting. The fitting (77) serves to connect the section 9.

FIGS. 29 and 30 show a cut design in isometric perspective of the section (15) having a straight double "H"-shaped section with four female fittings. The fittings (78, 79, 80 and 81) serve to connect the sections 2, 3 and 4.

The invention claimed is:

1. A building structure made of thermoplastic, comprising:

a plurality of first elements (1) each including a first rectangular-shaped side plate, and a second rectangular-shaped side plate, the first rectangular-shaped side plate and the second rectangular-shaped side plate being parallel to each other, a plurality of crossbars (4,9,12) installed separately between the first rectangular-shaped side plate and the second rectangular-shaped side plate, wherein the first rectangular-shaped side plate and the second rectangular-shaped side plate each has a plurality of female fittings (3,5,6,7,8,10,11,12) formed on an outside surface thereof and formed opposite to the plurality of crossbars, respectively, each of the female fittings being formed by two protrusion plates protruded from the surface of the side plate, a slot formed between the protrusion plates and one of the two protrusion plates having a rod-shaped protruding end portion;

wherein each of the first rectangular-shaped side plate and the second rectangular-shaped side plate has a top end portion formed with a U-shaped plate structure, which serves as a female fitting (1, 2), each of the first rectangular-shaped side plate and the second rectangular-shaped side plate each has a bottom end portion, which serves as a male fitting (14, 15), and which is able to be inserted into the female fittings (1, 2) of another first element;

a plurality of second elements each including a rectangular-shaped plate (18), four protrusion plates protrudingly formed on a first surface of the rectangular-shaped plate (18) and parallel to each other, each of the four protrusion plates having a rod-shaped protruding end portion, and thus forming four male fitting (17, 19, 20, 21), a first protrusion plate (16) protruding from a top edge of the rectangular-shaped plate and perpendicular to a second surface of the plate, and a second protrusion plate (22) protruding from a bottom edge of the rectangular-shaped plate (8) and perpendicular to the first surface of the rectangular-shaped plate, wherein the second surface is opposite to the first surface, and wherein the four male fittings (17, 19, 20, 21) are configured to correspond to the female fittings female (3,5,6,7,8,10,11,12) formed on the first rectangular-shaped side plate and the second rectangular-shaped side plate, respectively, such that the male fittings are able to be inserted into the female fittings;

a plurality of third elements each including a rectangular-shaped plate (28), four protrusion plates formed on a surface of the rectangular-shaped plate (28) and parallel to each other, each of the four protrusion plates having a rod-shaped protruding end portion, and thus forming four male fittings (24, 25, 26 and 29) on the surface of the rectangular-shaped plate (28), wherein a bottom end portion of the rectangular-shaped plate (28) is bent and protruded from the surface of the rectangular-shaped plate (28) and thus form a concave space on the bottom end portion, one of the male fittings (29) being formed on the bottom end portion, and wherein the four male fittings (24, 25, 26, 29) are configured to correspond to the four female fittings (3,5,6,7,8,10,11,12) formed on the first rectangular-shaped side plate and the second rectangular-shaped side plate, respectively, such that the male fittings are able to be inserted into the female fittings;

a plurality of fourth elements (34) each having a rectangular-shaped plate (34), four protrusion plates formed on a surface of the rectangular-shaped plate (28) and parallel to each other, each of the four protrusion plates having a rod-shaped protruding end portion, and thus forming four male fittings (31, 33, 35, 36) formed on a first surface of the rectangular-shaped plate (34), wherein a top end portion of the rectangular-shaped plate (34) is bent and protruded from the first surface of the rectangular-shaped plate (34), and thus form a L-shaped concave space on the top end portion of the rectangular-shaped plate (34), and a first protrusion plate (30) protruding from a top edge of the rectangular-shaped plate (34) and perpendicular to a second surface of the plate, and a second protrusion plate protruding from a bottom edge of the rectangular-shaped plate (34) and perpendicular to the first surface of the rectangular-shaped plate, wherein the second surface is opposite to the first surface, and wherein the four male fittings (31, 33, 35, 36) are configured to correspond to the female fittings female (3,5,6,7,8,10, 11,12) formed on the first rectangular-shaped side plate and the second rectangular-shaped side plate, respectively, such that the male fittings are able to be inserted into the female fittings;

a plurality of fifth elements each having a F-shaped plate including a first plate and a second plate perpendicular to the first plate, a third protrusion plate being formed on the second plate, and a fourth protrusion plate being formed between the first plate and the third protrusion plate, the fourth protrusion plate having a rod-shaped protruding end portion, thus two slots being formed between the first plate and the fourth protrusion plate, and between the third protrusion plate and the fourth protrusion plate, and thus two female fitting (37, 38) being formed on the F-shaped plate;

a plurality of sixth elements each having a rectangular-shaped plate (41), two protrusion plates being formed from a surface of two end portions of the rectangular-shaped plate, each of the two protrusion plates has an end portion including a U-shaped slot, which serves as two female fittings (40, 42), each of the two protrusion plates has a transversely protruded protrusion plate protruding from the two protrusion plates and thus form female fitting (43, 44, 45, 46);

a plurality of seventh elements each having a rectangular-shaped plate (49), a first protrusion plate (47) protruded perpendicularly from a top edge of the rectangular-shaped plate (49), a second L-shaped protrusion plate (52) protruded perpendicularly from a bottom edge of the rectangular-shaped plate (49), a L-shaped plate (48) formed on the rectangular-shaped plate (49) right below the first protrusion plate (47), a plurality of grooves (50, 51) formed on the rectangular-shaped plate (49), a middle protrusion plate protruded perpendicularly from the rectangular-shaped plate (49) between the L-shaped protrusion plate (52) and the L-shaped plate (48);

a plurality of eighth elements each having a rectangular-shaped plate, two protrusion plates formed on a fist surface of the rectangular-shaped plate, the two protrusion plates each having an end portion with two slots, which serves as female fittings (55,56,57,58), a protrusion plate protruded from a first end of the rectangular-shaped plate and perpendicular to the first surface, the protrusion plate having a top end portion formed with a slot, which serves as a female fitting (54), a U-shaped plate formed on the first end of the rectangular-shaped plate and opposite the protrusion plate protruded from the first end, the U-shaped plate serves as a female fitting (53), an E-shaped plate formed on a second end of the rectangular-shaped plate, the E-shaped plate thus forming two female fittings (59, 60), three protrusion plates formed on a second surface of the rectangular-shaped plate;

a plurality of ninth elements each having a U-shaped plate, which includes two side plates and a bottom plate connecting the two side plates, a T-shaped portion protrudingly formed on an outer surface of the bottom plate and thus form two slots, which serves as female fittings (64,66), two L-shaped protrusion plates formed on the two side plates, respectively, face to face, and thus forming two female fittings (65, 67), a plurality of tenth elements having a rectangular-shaped plate, four protrusion plates (68,69,70,71) protrudingly formed on a surface of the rectangular-shaped plate, each of the four protrusion plates has a hook-shaped end portion, which serves as four male fittings (68,69, 70,71), the four protrusion plates (68,69,70,71) being configured to correspond to the female fittings on the eighth element, such that the male fittings are able to be inserted into the female fittings;

a plurality of eleventh elements each having a rectangular-shaped plate, a top end portion of the rectangular-shaped plate being formed with a slot thus forming a female fitting (72), a bottom end portion of the rectangular-shaped plate is rod-shaped to thus form a male fitting (73);

a plurality of twelfth elements each having a U-shape plate, two end portions each having a rod-shaped protruding end portion and thus forming two male fittings (74,75), which are configured to correspond to the female fittings (65, 67) on the ninth element such that the male fittings are able to be inserted into the female fittings;

a plurality of thirteenth elements each having a L-shaped plate, an end portion of the L-shaped plate being rod-shaped protruding end portion and thus forming a fitting (76), which is configured to correspond to the female fitting (64, 66) on the ninth element such that the male fittings are able to be inserted into the female fittings;

a plurality of fourteenth elements each having a n-shaped plate, an end portion of the n-shaped plate being rod-shaped protruding end portion and thus forming a male fitting (77), which is configured to correspond to the female fitting (64, 66) on the ninth element such that the male fittings are able to be inserted into the female fittings; and a plurality of fifteenth elements each having five plates including a first plate, a second plate, a third plate, a fourth plate and a fifth plate, wherein the third plate connects the first plate, the second plate, the fourth plate and the fifth plate, the first plate, the second plate, the fourth plate and the fifth plate are parallel and the third plate is perpendicular to the first plate, the second plate, the fourth plate and the fifth plate, the fourth plate and the fifth plate are arranged between the first plate and the second plate, the fourth plate is next to the first plate, the fifth plate is next to the second plate, each of the fourth plate and the fifth plate has two rod-shaped protruding end portions such that four slots are formed between the first plate and the fourth plate, and between the second plate and the fifth plate, the four slots serve as four fittings (78, 79, 80, 81), which are configured to connect the plurality of second element, or the plurality of third elements, or the plurality of fourth elements;

wherein when assembling the elements, the plurality of first elements (1) are stacked on top of one another, in which male fittings (14, 15) of an upper first element are inserted into female fittings (1, 2) of a lower first element next to the upper first element, each of the second elements, or each of the third elements, or each of the fourth elements is attached to a corresponding first element (1) by inserting the male fittings on the second element, or the third element, or the fourth element into corresponding female fittings on the corresponding first element, the first element on the bottom is fixed on the sixth element by inserting the male fitting into the female fitting s on the sixth element, the eighth element is fixed on the first element on the top, the tenth element is fixed on the eighth element by inserting male fittings on the tenth element into the female fitting on the eighth element, the twelfth element is fixed on the ninth element by inserting male fittings on the twelfth element into the female fitting on the ninth element, and the thirteenth element or the fourteenth element is fixed with the ninth element by inserting male fittings on the thirteenth or fourteenth element into the female fitting on the ninth element.

* * * * *